US007567761B2

(12) United States Patent
Kin et al.

(10) Patent No.: US 7,567,761 B2
(45) Date of Patent: Jul. 28, 2009

(54) IMAGE FORMING APPARATUS AND A METHOD OF CONTROLLING THE IMAGE FORMING APPARATUS

(75) Inventors: Hidenori Kin, Shiojiri (JP); Shinsuke Yokote, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 252 days.

(21) Appl. No.: 11/677,495

(22) Filed: Feb. 21, 2007

(65) Prior Publication Data

US 2007/0200908 A1 Aug. 30, 2007

(30) Foreign Application Priority Data

Feb. 24, 2006 (JP) ..... 2006-048174
Feb. 24, 2006 (JP) ..... 2006-048175
Feb. 24, 2006 (JP) ..... 2006-048176

(51) Int. Cl.
*G03G 15/00* (2006.01)

(52) U.S. Cl. ..... 399/12; 399/49; 399/72

(58) Field of Classification Search ..... 399/9, 399/12, 24, 25, 27, 29, 30, 38, 43, 49, 72
See application file for complete search history.

(56) References Cited

U.S. PATENT DOCUMENTS 5,839,018 A * 11/1998 Asanuma et al. ..... 399/43
6,650,849 B2 * 11/2003 Shimura ..... 399/49
6,871,026 B2 3/2005 Shimura et al. ..... 399/12
7,031,020 B1 * 4/2006 Aoki et al. ..... 358/1.9
7,190,927 B2 * 3/2007 Takada ..... 399/299
7,333,758 B2 * 2/2008 Munakata et al. ..... 399/299
2004/0105689 A1 6/2004 Shimura et al. ..... 399/12
2005/0030562 A1 2/2005 Hama et al. ..... 358/1.9

FOREIGN PATENT DOCUMENTS

JP 2004-078062 3/2004
JP 2004-177928 6/2004
JP 2005-316242 11/2005

* cited by examiner

*Primary Examiner*—Hoan H Tran
(74) *Attorney, Agent, or Firm*—Hogan & Hartson LLP

(57) ABSTRACT

An image forming apparatus, includes: a developer which is attachable to and detachable from an apparatus main body and which holds toner; an image forming section which forms a toner image using the toner held inside the developer; and a controller which executes a density control operation of forming a patch image using the toner held inside the developer and controlling an image forming condition for the image forming section based on a density detection result of the patch image, wherein the developer includes a memory which stores specific information regarding an attribute which is specific to the developer, and the controller determines a mode of the density control operation based on the specific information read out from the memory.

18 Claims, 13 Drawing Sheets

FIG. 6

| DRIVING TIME OF DEVELOPING ROLLER (SEC) | TONER CONSUMPTION AMOUNT (%) | REMAINING TONER AMOUNT (%) | TARGET DENSITY VALUE (IN ANY DESIRED UNITS) | |
|---|---|---|---|---|
| | | | PHOTOSENSITIVE MEMBER: INITIAL STAGE | PHOTOSENSITIVE MEMBER: LATER STAGE |
| 0~51659 | 5 | 95 | 119 | 106 |
| | 20 | 80 | 119 | 106 |
| | 40 | 60 | 119 | 106 |
| | 60 | 40 | 115 | 106 |
| | 80 | 20 | 115 | 106 |
| 51660~68879 | 5 | 95 | 119 | 111 |
| | 20 | 80 | 119 | 111 |
| | 40 | 60 | 119 | 111 |
| | 60 | 40 | 119 | 111 |
| | 80 | 20 | 115 | 106 |
| 68880~95939 | 5 | 95 | 122 | 113 |
| | 20 | 80 | 122 | 113 |
| | 40 | 60 | 122 | 113 |
| | 60 | 40 | 119 | 111 |
| | 80 | 20 | 115 | 106 |
| 95940~113159 | 5 | 95 | 122 | 116 |
| | 20 | 80 | 122 | 116 |
| | 40 | 60 | 122 | 113 |
| | 60 | 40 | 119 | 111 |
| | 80 | 20 | 115 | 106 |
| 113160~123000 (Tmax) | 5 | 95 | 124 | 118 |
| | 20 | 80 | 122 | 116 |
| | 40 | 60 | 122 | 113 |
| | 60 | 40 | 119 | 111 |
| | 80 | 20 | 115 | 106 |

FIG. 7

| DRIVING TIME OF DEVELOPING ROLLER (SEC) | TONER CONSUMPTION AMOUNT (%) | REMAINING TONER AMOUNT (%) | TARGET DENSITY VALUE (IN ANY DESIRED UNITS) | |
|---|---|---|---|---|
| | | | PHOTOSENSITIVE MEMBER: INITIAL STAGE | PHOTOSENSITIVE MEMBER: LATER STAGE |
| 0~24599 | 45 | 55 | 130 | 114 |
| | 60 | 40 | 130 | 114 |
| | 70 | 30 | 130 | 114 |
| | 85 | 15 | 130 | 113 |
| | 95 | 5 | 129 | 113 |
| 24600~39899 | 45 | 55 | 130 | 118 |
| | 60 | 40 | 130 | 118 |
| | 70 | 30 | 130 | 118 |
| | 85 | 15 | 130 | 114 |
| | 95 | 5 | 129 | 113 |
| 36900~49199 | 45 | 55 | 131 | 118 |
| | 60 | 40 | 131 | 118 |
| | 70 | 30 | 131 | 118 |
| | 85 | 15 | 130 | 114 |
| | 95 | 5 | 129 | 113 |
| 49200~67649 | 45 | 55 | 133 | 123 |
| | 60 | 40 | 133 | 123 |
| | 70 | 30 | 131 | 118 |
| | 85 | 15 | 130 | 114 |
| | 95 | 5 | 129 | 113 |
| 67650~123000 (Tmax) | 45 | 55 | 133 | 128 |
| | 60 | 40 | 133 | 123 |
| | 70 | 30 | 131 | 118 |
| | 85 | 15 | 130 | 114 |
| | 95 | 5 | 129 | 113 |

FIG. 10

TONER: A (CRUSHED TONER)

| DETECTED DENSITY ON BELT (EVALUATION VALUE) | IMAGE DENSITY ON SHEET (IN ANY DESIRED UNITS) | |
|---|---|---|
| | REMAINING TONER AMOUNT: LARGE | REMAINING TONER AMOUNT: SMALL |
| 0.00 | 0 | 0 |
| 0.05 | 7 | 5 |
| 0.10 | 14 | 13 |
| 0.15 | 22 | 22 |
| 0.20 | 30 | 32 |
| 0.25 | 38 | 42 |
| 0.30 | 48 | 53 |
| 0.35 | 60 | 64 |
| 0.40 | 72 | 76 |
| 0.45 | 86 | 89 |
| 0.50 | 100 | 104 |
| 0.55 | 115 | 120 |
| 0.60 | 131 | 137 |
| 0.65 | 146 | 154 |
| 0.70 | 162 | 169 |
| 0.75 | 177 | 184 |
| 0.80 | 192 | 197 |
| 0.85 | 207 | 210 |
| 0.90 | 224 | 223 |
| 0.95 | 243 | 242 |
| 1.00 | 255 | 255 |

FIG. 11

TONER: B (POLYMERIZED TONER)

| DETECTED DENSITY ON BELT (EVALUATION VALUE) | IMAGE DENSITY ON SHEET (IN ANY DESIRED UNITS) | |
|---|---|---|
| | REMAINING TONER AMOUNT: LARGE | REMAINING TONER AMOUNT: SMALL |
| 0.00 | 0 | 0 |
| 0.05 | 7 | 5 |
| 0.10 | 15 | 13 |
| 0.15 | 23 | 21 |
| 0.20 | 31 | 29 |
| 0.25 | 40 | 38 |
| 0.30 | 49 | 48 |
| 0.35 | 59 | 59 |
| 0.40 | 71 | 71 |
| 0.45 | 85 | 85 |
| 0.50 | 99 | 101 |
| 0.55 | 115 | 117 |
| 0.60 | 132 | 134 |
| 0.65 | 148 | 151 |
| 0.70 | 164 | 167 |
| 0.75 | 180 | 182 |
| 0.80 | 194 | 195 |
| 0.85 | 209 | 207 |
| 0.90 | 225 | 220 |
| 0.95 | 242 | 237 |
| 1.00 | 255 | 255 |

IMAGE FORMING APPARATUS AND A METHOD OF CONTROLLING THE IMAGE FORMING APPARATUS

CROSS REFERENCE TO RELATED APPLICATION

The disclosure of Japanese Patent Applications enumerated below including specification, drawings and claims is incorporated herein by reference in its entirety:

No. 2006-48174 filed Feb. 24, 2006;

No. 2006-48175 filed Feb. 24, 2006; and

No. 2006-48176 filed Feb. 24, 2006.

BACKGROUND

1. Technical Field

The present invention relates to a density control technique for an image forming apparatus which forms a toner image using toner contained in a developer which is attachable to and detachable from an apparatus main body.

2. Related Art

An image forming apparatus which forms an image using toner, such as a copier machine, a printer and a facsimile machine, executes a density control operation for forming a predetermined patch image using toner, detecting a density of the patch image, controlling an image forming condition based on the density detection result, to thereby obtain a stable image quality. According to a technique described in JP-A-2004-177928 for instance, in an apparatus which is structured to use with a developer which stores toner attached to an apparatus main body, the timing of executing the density control operation is determined based on the use history of the developer. To be more precise, the density control operation is executed when one of the operation time of a developing roller provided in the developer and the remaining toner amount in the developer reaches a predetermined threshold value. The purpose of this is to maintain a stable image density regardless of a change of the property of toner inside the developer with time by means of execution of the density control operation at such timing which corresponds to the use history of the developer.

The timing of executing the density control operation is determined based only on the use history of the developer irrespectively of the type and the like of contained toner according to the conventional technique described above. However, the property of toner may change differently with time depending upon the difference of the manufacturing method of the toner or the difference of the production batches. For example, between toner manufactured by a crushing method (crushed toner) and toner manufactured by a polymerization method (polymerized toner), the speed of the toner getting degraded is greatly different due to different degrees of sphericity, different particle diameter distributions. Hence, the timing of executing the density control operation should preferably determined considering the property of toner held inside a developer to use as well, in which respect the conventional technique described above leaves room for improvement.

Meanwhile, according to a technique described in JP-A-2004-78062 for example, an apparatus which is used with a developer which stores toner attached to an apparatus main body deals with different toner properties among developers in the following manner. That is, toner properties are classified in advance into a several ranks, memories of the developers store the ranking of the toner inside the developers, and the apparatus main body executes a density control operation using values which correspond to the ranking of the toner chosen from among plural sets of control parameters prepared for the respective ranks.

In accordance with the conventional technique described above, variation of the properties of the toner to be used in the apparatus is tolerated only within a range predicted in advance. However, for reduction of the manufacturing cost of the toner or a running cost of the apparatus, a more enhanced tolerable range for the toner properties is desirable. In this respect, the conventional technique described above leaves room for improvement.

Further, in light of the fact that a density detected on an intermediate transfer belt, which is an intermediate image carrier, does not necessarily match with the optical density of an image finally fixed on a recording material, in a technique described in JP-A-2005-316242 for example, the density detected on the intermediate transfer belt is converted into an image density on the recording material with reference to a conversion table and the tone correction characteristic of the apparatus is determined using thus obtained conversion result.

According to the conventional technique described above, one-to-one correspondence between densities detected on the intermediate transfer belt and optical densities of images on the recording material is made and the conversion processing is performed. When the types of toner to use are limited, the properties of the toner are known, and therefore, this kind of method causes no problem. However, the correlation between the densities detection result on the intermediate transfer belt and image densities on the recording material is slightly different depending upon the types of toner (types of pigments and external additives, manufacturing methods, and the like) as well. The conventional technique described above therefore fails to meet the demand to form images using various types of toner and leaves room for improvement in this respect.

SUMMARY

One advantage according to an aspect of the invention is that it is possible to provide a technique in an image forming apparatus which forms a toner image using toner contained in a developer which is attachable to and detachable from an apparatus main body and in a method of controlling such an apparatus, the technique being possible to use various types of toner exhibiting different properties and to form images in a stable and favorable image quality.

The image forming apparatus and the method of controlling the same according to an aspect of the invention stores specific information in a memory of a developer the specific information regarding an attribute which is specific to the developer, the developer being attachable to and detachable from an apparatus main body, reads out the specific information stored in the memory, determines based on the specific information a mode of a density control operation, and executes the density control operation in thus determined mode, the density control operation forming a toner image as a patch image using toner stored in the developer, and controlling an image forming condition for an image forming section based on the density detection result of the toner image.

For instance, in a first embodiment of the image forming apparatus according to an aspect of the invention, timing information regarding a timing of executing the density control operation using the developer is stored in the memory as the specific information, the timing information stored in the memory provided in the developer is read out, and the density control operation is executed at timing determined based on the timing information.

In this structure, the density control operation for determining the image forming condition is carried out at the timing determined based on the timing information read out from the memory of the developer. This makes it possible to execute the density control operation at the timing which is appropriate considering the type and the property of toner inside the developer, and hence, to maintain an image quality more stably and favorably. Further, a combination of a controller which performs the density control operation at the timing which is based on the information received from the developer and the developer which has the information regarding the timing at which the density control operation should be executed allows use of a wider varieties of toner, which reduces a running cost of the apparatus.

Further, in a second embodiment of the image forming apparatus according to an aspect of the invention, a specific-to-developer control parameter in accordance with attributes of the developer and the toner inside the developer is stored in the memory as the specific information, and the specific-to-developer control parameter read out from the memory is applied in the density control operation.

In this structure, since the parameter regarding the attributes of the developer and the toner among control parameters required for the density control operation is stored in the memory of the developer, it is possible to properly control the densities of images in all instances using developers and toner having various different characteristics, and therefore, to form images in a stable and favorable image quality.

Further, in a third embodiment of the image forming apparatus according to an aspect of the invention, attribute information regarding the attribute of toner held in the developer is stored in the memory as the specific information, and in the density control operation, the density detection result of the patch image on the image carrier is converted into an image density on the recording material and an operating condition for an image forming operation performed by an image forming section is adjusted based on this conversion result, whereby the image density on the recording material is controlled. Moreover, the conversion processing characteristic of this conversion processing is set based on the attribute information read out from the memory.

In this structure, the conversion processing characteristic in converting a density detection result on the image carrier into an image density on the recording material is not uniform but is set based on the attribute information regarding the attribute of the toner which is used. The attribute information is stored in the memory which is provided in the developer which actually holds the toner. Since this eliminates the necessity for the apparatus main body to grasp the property of the toner in advance, it is possible to form images using various types of toner regardless of whether the properties of the toner are already known or not. In addition, since the conversion processing is performed with the conversion processing characteristic which corresponds to the property of toner, it is possible to optimally control an image density on the recording material. As a result, it becomes possible to form images in a stable and favorable image quality using toner exhibiting various properties.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 6 is a drawing which shows a first example of the target density value tables.

FIG. 7 is a drawing which shows a second example of the target density value tables.

FIG. 10 is a drawing which shows one example of the OD value conversion tables.

FIG. 11 is a drawing which shows other example of the OD value conversion tables.

BRIEF DESCRIPTION OF EXEMPLARY EMBODIMENTS

Figure 1:
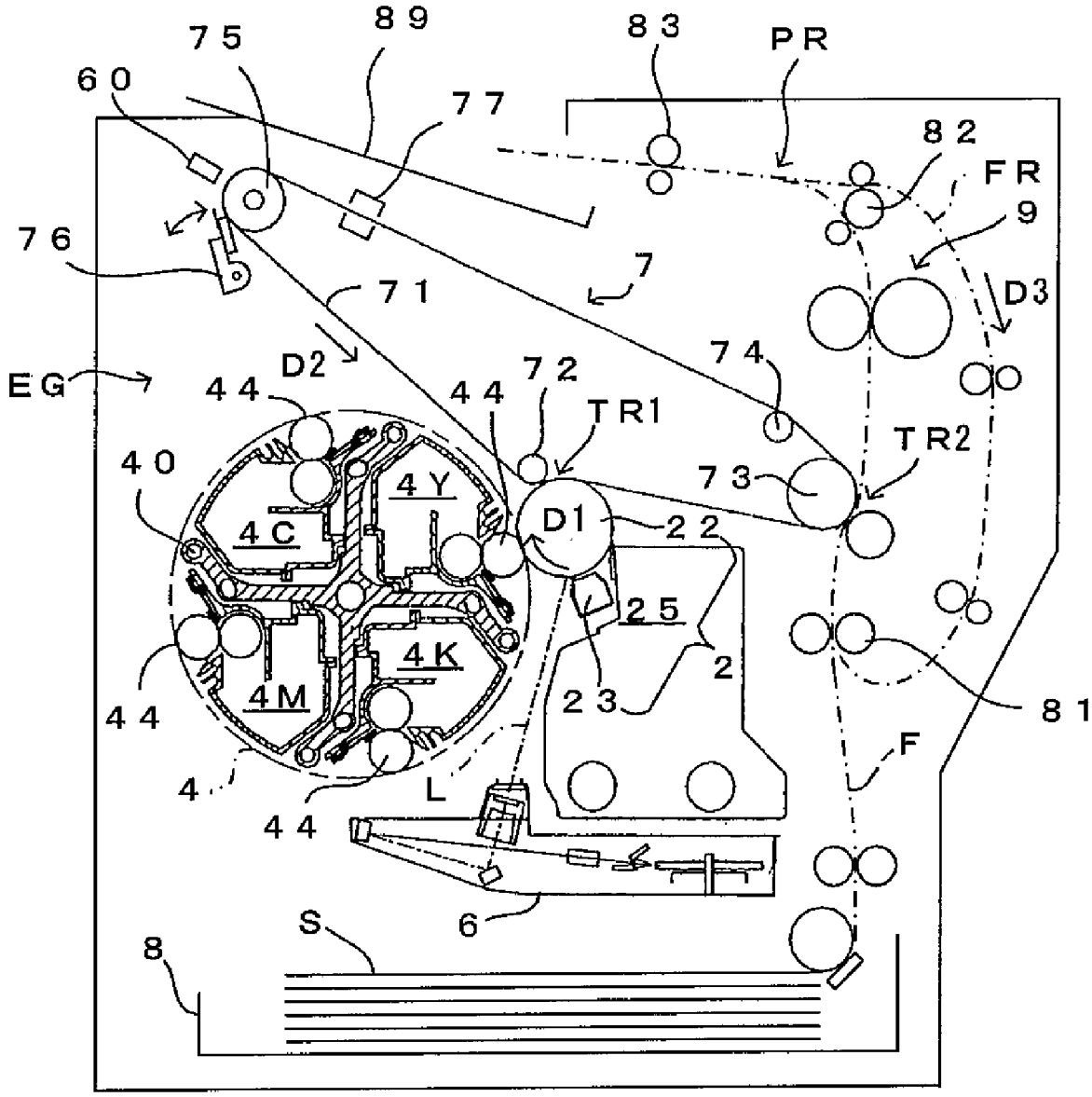
FIG. 1 is a drawing which shows an embodiment of an image forming apparatus according to the invention.
Figure 2:
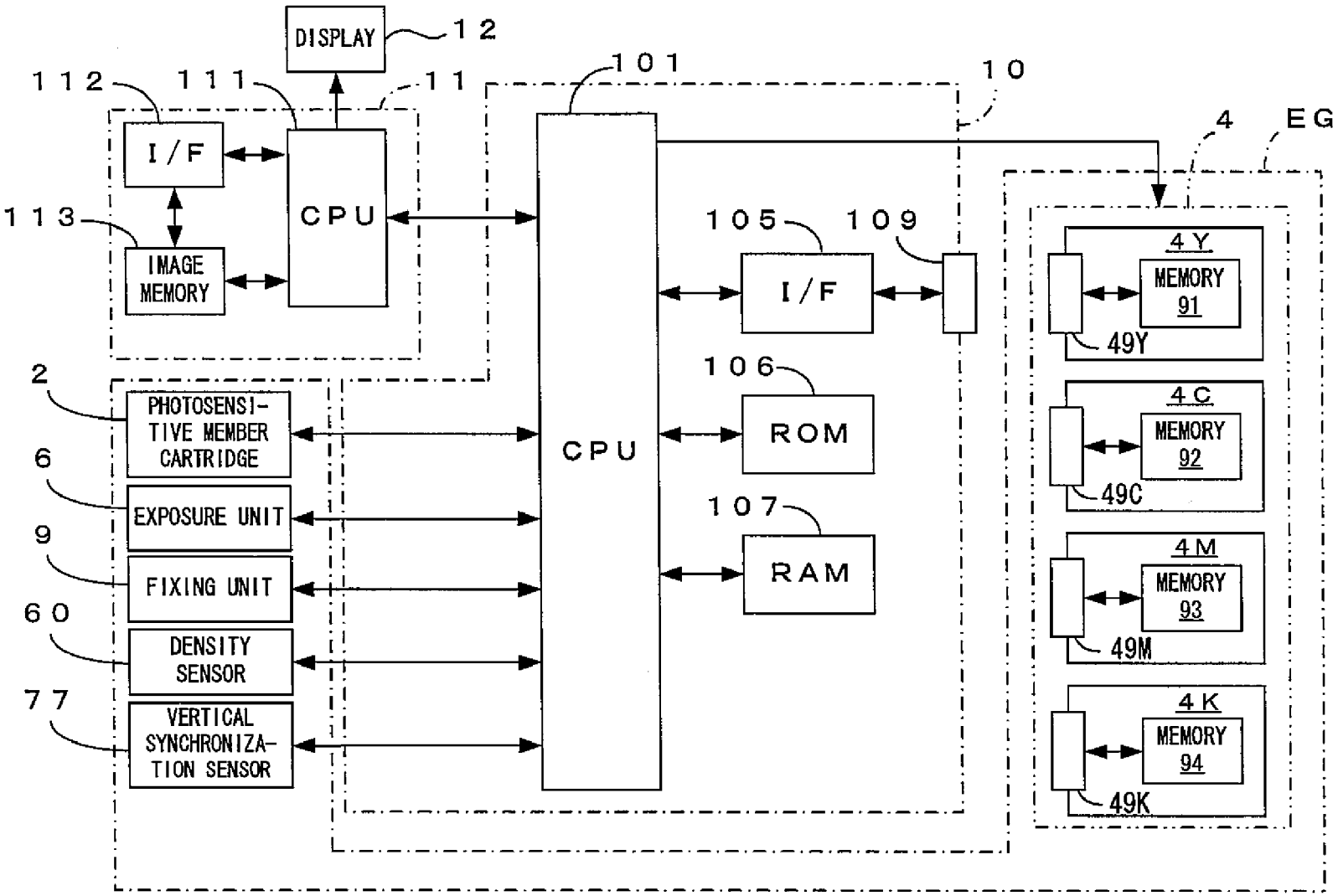
FIG. 2 is a block diagram of an electric structure of the image forming apparatus shown in FIG. 1.

FIG. 1 is a drawing which shows an embodiment of an image forming apparatus according to the invention. FIG. 2 is a block diagram of an electric structure of the image forming apparatus shown in FIG. 1. The illustrated apparatus is an image forming apparatus which overlays toner (developer) in four colors of yellow (Y), cyan (C), magenta (M) and black (K) one atop the other and accordingly forms a full-color image, or forms a monochrome image using only black toner (K). In the image forming apparatus, when an image signal is fed to a main controller 11 from an external apparatus such as a host computer, a CPU 101 provided in an engine controller 10 controls respective portions of an engine EG in accordance with an instruction received from the main controller 11 to perform a predetermined image forming operation and forms an image which corresponds to the image signal on a sheet S.

In the engine EG, a photosensitive member 22 is disposed so that the photosensitive member 22 can freely rotate in the arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a used toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from a main apparatus body as one integrated unit.

An exposure unit 6 emits a light beam L toward the outer circumferential surface of the photosensitive member 22 which is thus charged by the charger unit 23. The exposure unit 6 makes the light beam L expose on the photosensitive member 22 in accordance with the image signal fed from the external apparatus and forms an electrostatic latent image which corresponds to the image signal.

The developer unit 4 develops thus formed electrostatic latent image with toner. That is, in this embodiment, the developer unit 4 comprises a support frame 40 which is disposed for free rotations about a rotation shaft which is perpendicular to the plane of FIG. 1, and also comprises a yellow developer 4Y, a cyan developer 4C, a magenta developer 4M and a black developer 4K which house toner of the respective colors and are formed as cartridges which are freely attachable to and detachable from the support frame 40. The engine controller 10 controls the developer unit 4. The developer unit 4 is driven into rotations based on a control instruction from the engine controller 10. And when the developers 4Y, 4C, 4M and 4K are selectively positioned at a predetermined developing position which faces the photosensitive member 22 abutting thereon or with a predetermined gap in-between, toner of the color corresponding to the selected developer is supplied onto the surface of the photosensitive member 22 from a developer roller 44 provided in the selected developer which carries toner of this color and has been applied with the predetermined developing bias. As a result, the electrostatic latent image on the photosensitive member 22 is visualized in the selected toner color.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby rotate the intermediate transfer belt 71 in a predetermined rotation direction D2. For transfer of a color image on the sheet S, toner images in the respective colors formed on the photosensitive member 22 are superposed one atop the other on the intermediate transfer belt 71, thereby forming a color image, and the color image is secondarily transferred onto the sheet S which is unloaded from a cassette 8 one at a time and transported to a secondary transfer region TR2 along a transportation path F.

At this stage, for the purpose of correctly transferring the image held by the intermediate transfer belt 71 onto the sheet S at a predetermined position, the timing of feeding the sheet S into the secondary transfer region TR2 is managed. To be more specific, there is a gate roller 81 disposed in front of the secondary transfer region TR2 on the transportation path F. As the gate roller 81 rotates in synchronization to the timing of rotations of the intermediate transfer belt 71, the sheet S is fed into the secondary transfer region TR2 at predetermined timing.

A fixing unit 9 fixes the toner image now borne by the sheet S, and the sheet S is transported to a discharge tray part 89, which is attached to the top surface of the main apparatus body, via a pre-discharge roller 82 and a discharge roller 83. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. While the sheet S is returned back to the transportation path F again before arriving at the gate roller 81, the surface of the sheet S which abuts on the intermediate transfer belt 71 in the secondary transfer region TR2 and is to receive a transferred image is at this stage opposite to the surface which already bears the image. In this fashion, it is possible to form images on the both surfaces of the sheet S.

Further, there is a cleaner 76 in the vicinity of the roller 75. The cleaner 76 can freely abut on and move away from the roller 75, owing to an electromagnetic clutch not shown. In a condition that the cleaner 76 has moved to the roller 75, the blade of the cleaner 76 abuts on the surface of the intermediate transfer belt 71 spanning around the roller 75 and removes toner which remains adhering to the outer circumferential surface of the intermediate transfer belt 71 even after the secondary transfer.

During image transfer onto the sheet S within the secondary transfer region TR2, the cleaner 76 is controlled to abut on and move away from the intermediate transfer belt 71 for removal of toner remaining on the intermediate transfer belt 71 during the same belt revolution as that for the image transfer. Hence, for the apparatus to continuously form monochrome images for instance, as an image transferred onto the intermediate transfer belt 71 within the primary transfer region TR1 gets immediately transferred onto the sheet S within the secondary transfer region TR2, the cleaner 76 remains abutting on the belt. In the meantime, to form a color image, the cleaner 76 needs stay away from the intermediate transfer belt 71 while toner images in the respective colors are being superimposed one atop the other. In the same belt revolution during which the toner images in the respective colors are superimposed one atop the other and a resulting full-color image is secondarily transferred onto the sheet S, the cleaner 76 abuts on the intermediate transfer belt 71 to remove the remaining toner.

Further, there are a density sensor 60 and a vertical synchronization sensor 77 in the vicinity of the roller 75. The density sensor 60 is disposed facing the surface of the intermediate transfer belt 71, and measures the image density of a toner image formed on the outer circumferential surface of the intermediate transfer belt 71 when needed. This apparatus adjusts operating conditions for the respective portions of the apparatus which influence the quality of an image, such as a developing bias applied upon each developer and the intensity of the light beam L, based on the measurement result. The density sensor 60 is structured so as to output, using a reflection-type photosensor for example, a signal which corresponds to the image density in an area having a predetermined size on the intermediate transfer belt 71. Rotating the intermediate transfer belt 71 and regularly sampling the output signal from the density sensor 60, the CPU 101 detects the image densities of the respective parts of a toner image on the intermediate transfer belt 71.

The vertical synchronization sensor 77 is a sensor which detects a reference position of the intermediate transfer belt 71 and functions as a sensor for obtaining a synchronizing signal outputted in association with a rotation of the intermediate transfer belt 71, namely a vertical synchronizing signal Vsync. In this apparatus, the operations of the individual parts of the apparatus are controlled based on the vertical synchronizing signal Vsync for the purposes of synchronizing the operation timings of the individual parts and precisely superimposing the toner images formed with toners of the respective colors on each other. The vertical synchronizing signal Vsync is counted and accumulated by the CPU 101.

Further, as shown in FIG. 2, the developers 4Y, 4C, 4M and 4K respectively mount memories 91 through 94 which store data regarding the production batches and the usage histories, the remaining toner amounts and the like of the associated developers. Wireless communication units 49Y, 49C, 49M and 49K are additionally provided in the developers 4Y, 4C, 4M and 4K. When needed, these units selectively establish non-contact data telecommunications with a wireless communication unit 109 which is provided in the main apparatus body and data are transferred between the CPU 101 and the respective memories 91 through 94 via the interface 105, thereby managing various types of information regarding the developers such as information on management of consumables. Although non-contact data transfer is done through wireless telecommunications which are established electromagnetically according to this embodiment, connectors or the like may be provided in the main apparatus body and the respective developers and the main apparatus body and the respective developers may transfer data with each other as the connectors or the like are mechanically fit to each other.

Further, as shown in FIG. 2, the apparatus comprises a display 12 which is controlled by a CPU 111 of the main controller 11. The display 12 is formed by a liquid crystal display for instance, and shows, in response to a control command from the CPU 111, predetermined messages which are indicative of operation guidance for a user, a progress in the image forming operation, abnormality in the apparatus, the timing of exchanging any one of the units, etc.

In FIG. 2, denoted at 113 is an image memory which is provided in the main controller 11, so as to store an image which is fed from an external apparatus such as a host computer via an interface 112. Denoted at 106 is a ROM which stores a calculation program executed by the CPU 101, control data for control of the engine EG, etc. Denoted at 107 is a RAM which temporarily stores a calculation result derived by the CPU 101, other data, etc.

Figure 3:
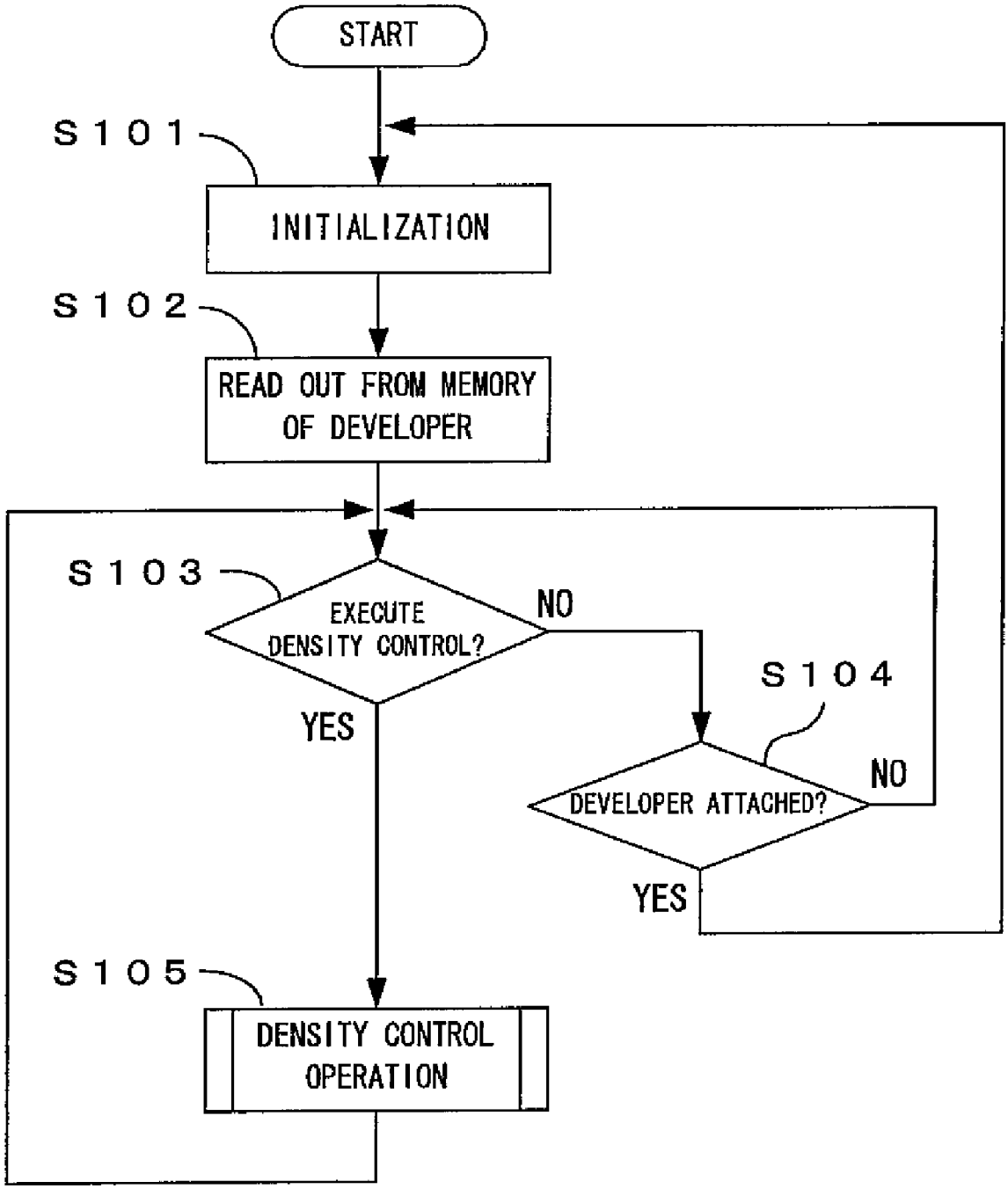
FIG. 3 is a flow chart which outlines the control operation in this apparatus.

FIG. 3 is a flow chart which outlines the control operation in this apparatus. In this apparatus, upon power-on of the apparatus, the CPU 101 provided in the engine controller 10 performs the processing shown in FIG. 3 in accordance with a control program stored in advance within the ROM 106. While this apparatus performs the image forming operation when ready to execute the image forming operation and when provided with an image signal from an external apparatus, the image forming operation is omitted in the flow chart in FIG. 3 as it is executed by means of an interruption processing.

During this processing, the respective sections of the apparatus are initialized first (Step S101). The initialization includes clearing of the image memory 113, confirmation that the photosensitive member cartridge 2 has been attached, confirmation that the developer has been attached to the developing unit 4, an operation of rotating the intermediate transfer belt 71 to measure the rotation cycles of the same, etc.

Next, with the developing unit 4 rotating, the information stored in the memories 91 through 94 which are provided respectively in the developers 4Y, 4C, 4M and 4K is read out one after another and stored in the RAM 107 (Step S102). The information read at this stage contains: (1) information regarding the timing of executing the density control operation; (2) information regarding a target density value during the density control operation; and (3) an error threshold value for a patch image density.

In this apparatus, updated and stored when needed as information to manage the use histories of the developer 4Y, . . . , in the RAM 107 are the toner consumption amount in each developer and the integrated value of the driving time of the developing roller 44 of each developer. The toner consumption amount tells how much toner still remains in each developer. Meanwhile, the rotation time of the developing roller 44 expresses the degree of deterioration of the toner inside the associated developer. These pieces of information are stored in the memories 91, . . . , as well which are provided in these developers, and updated as needed when execution of the image forming operation has changed these values. This ensures that the developers retain the use history information regarding themselves even after detached, which makes it possible to appropriately manage the lifetimes of the developers.

As the amount of the remaining toner in each developer decreases and the toner gets deteriorated, the densities of images formed under the same image forming condition change. This is because selective development as is often referred to gradually changes the distribution of the particle diameters of the toner and the distribution of the charging amount of the toner inside the developer. In order to maintain image densities constant therefore, it is necessary to re-adjust the image forming condition at predetermined timing. Noting this, this apparatus executes the density control operation (described later), which aims at adjustment of the image forming condition, when one of the toner consumption amount (or the remaining toner amount) in each developer and the driving time of the associated developing roller 44 reaches a predetermined threshold value. The toner consumption amount in each developer and the driving time of the developing roller of the developer will be hereinafter collectively referred to as the "use history information" of the developer, and the threshold value mentioned above which is set in accordance with these and triggers the density control operation will be hereinafter referred to as the "control threshold value".

Figure 4:
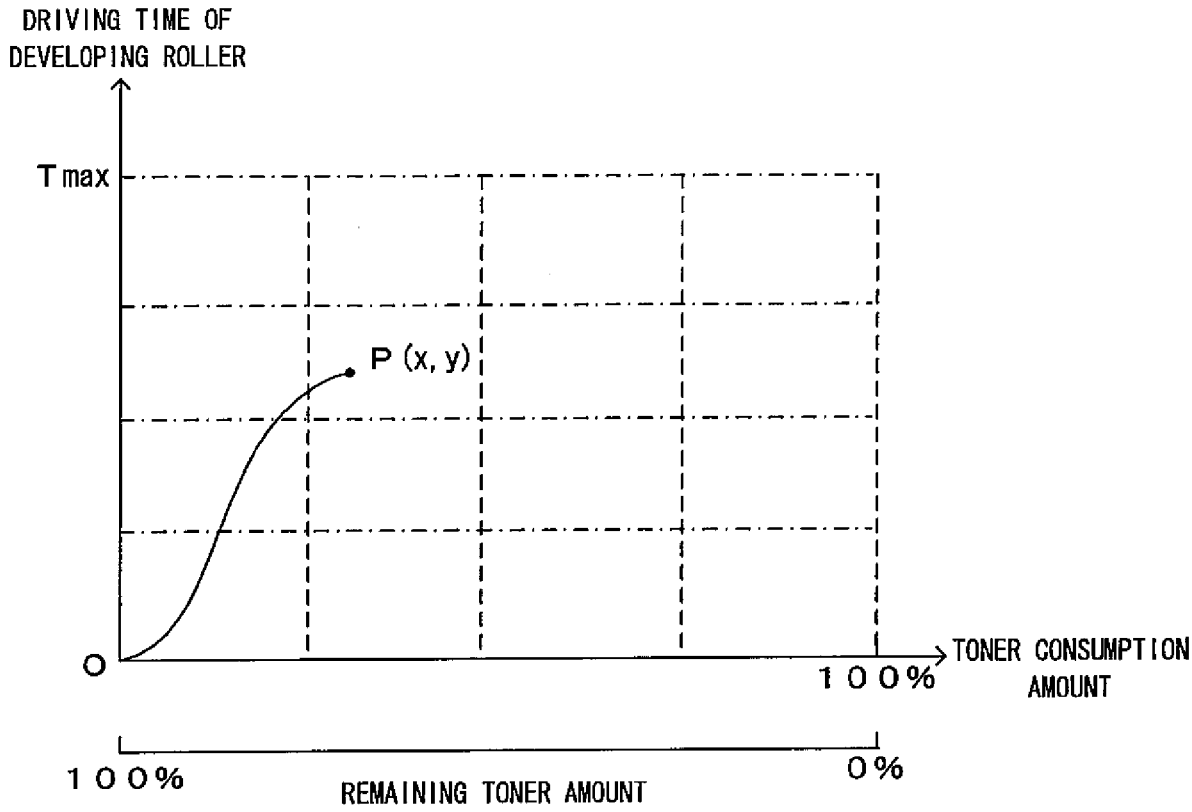
FIG. 4 is a chart for describing the timing of executing the density control operation.

FIG. 4 is a chart for describing the timing of executing the density control operation. As shown in FIG. 4, when the toner consumption amount (the remaining toner amount) is plotted along the horizontal axis (X-axis) and the driving time of the developing roller is plotted along the vertical axis (Y-axis) to express the use history of each developer, the origin O at which the toner consumption amount is 0% (i.e., the remaining toner amount is 100%) and the driving time of the developing roller is 0 second represents a new developer. Since the toner consumption amount and the driving time of the developing roller increase as the developer is used more, the position of P (x, y) expressing the developer moves toward the upper right of this chart. This apparatus performs the density control operation when the trajectory of P (x, y) crosses a control threshold value (denoted at the dashed line) which is set in accordance with the toner consumption amount or a control threshold value (denoted at the dashed-dotted line) which is set in accordance with the driving time of the developing roller. These control thresholds are stored in the memories 91, . . . of the developer 4Y, . . . and the CPU 101 reads out these control threshold values and store them in the RAM 107. Denoted at Tmax in FIG. 4 is the design lifetime of the developing roller.

The control operation will be described continuously, referring back to FIG. 3. The CPU 101 also manages the use history information of each developer which changes as the developer is used more, and compares a value representing the use history information with the control threshold values above as needed to thereby determine whether to perform the density control operation (Step S103). To be more specific, the CPU 101 determines to execute the density control operation when at least one of the toner consumption amount and the driving time of the developing roller of the developer reaches the control threshold values read out from the memory of the developer.

Meanwhile, when making a judgment at Step S103 immediately after power-on, the CPU determines "YES", i.e., determines to execute the density control operation irrespectively of whether the use history information has reached the control threshold values. This is because the optimal operation conditions for the apparatus may have significantly changed due to a change of the environment surrounding the apparatus during power-off, an exchange of any unit of the apparatus, etc. Hence, during the processing at this stage, the sequence proceeds to the density control operation at Step S105. The density control operation will be described in detail later.

On the other hand, when determining "NO" at Step S103, that is, when the use history information has not reached the control threshold values, the CPU then determines whether a new developer has been attached while a current is being applied in the apparatus (Step S104). Whether a new developer has been attached is determined in the following manner for instance. First, in the event that there is an attached developer at a position within the developing unit 4 where no developer has been mounted, this developer is a newly attached developer. Further, the information specific to the developers (such as the serial numbers assigned to the developers) read out from the memories of the developers at Step S102 is matched against the information stored in the RAM 107, whereby whether the developer has been exchanged is identified. In the event that it is possible to confirm a fact that a developer is attached based on opening/closing of a cover of the apparatus by a user, on manipulation of a button by the user or the like, a similar judgment may be made in accordance with whether such a manipulation has been performed.

When a new developer has been attached, the sequence returns back to Step S101 and starts over with the initialization processing. A judgment at Step S103 in this instance is "YES", like immediately after power-on. On the contrary, when no new developer has been attached, the sequence returns back to Step S103.

The operation of the apparatus is thus as follows approximately. First, right after power-on of the apparatus, the CPU 101 reads out the information stored in the memories of the respective developers and the density control operation described next is thereafter carried out. This remains the same when a new developer has been attached (or the old developer has been exchanged with new one) while a current is being applied in the apparatus. The density control operation is executed also when the use history information of any developer reaches the control threshold values read from the memory of the developer as a result of execution of the image forming operation.

Figure 5:
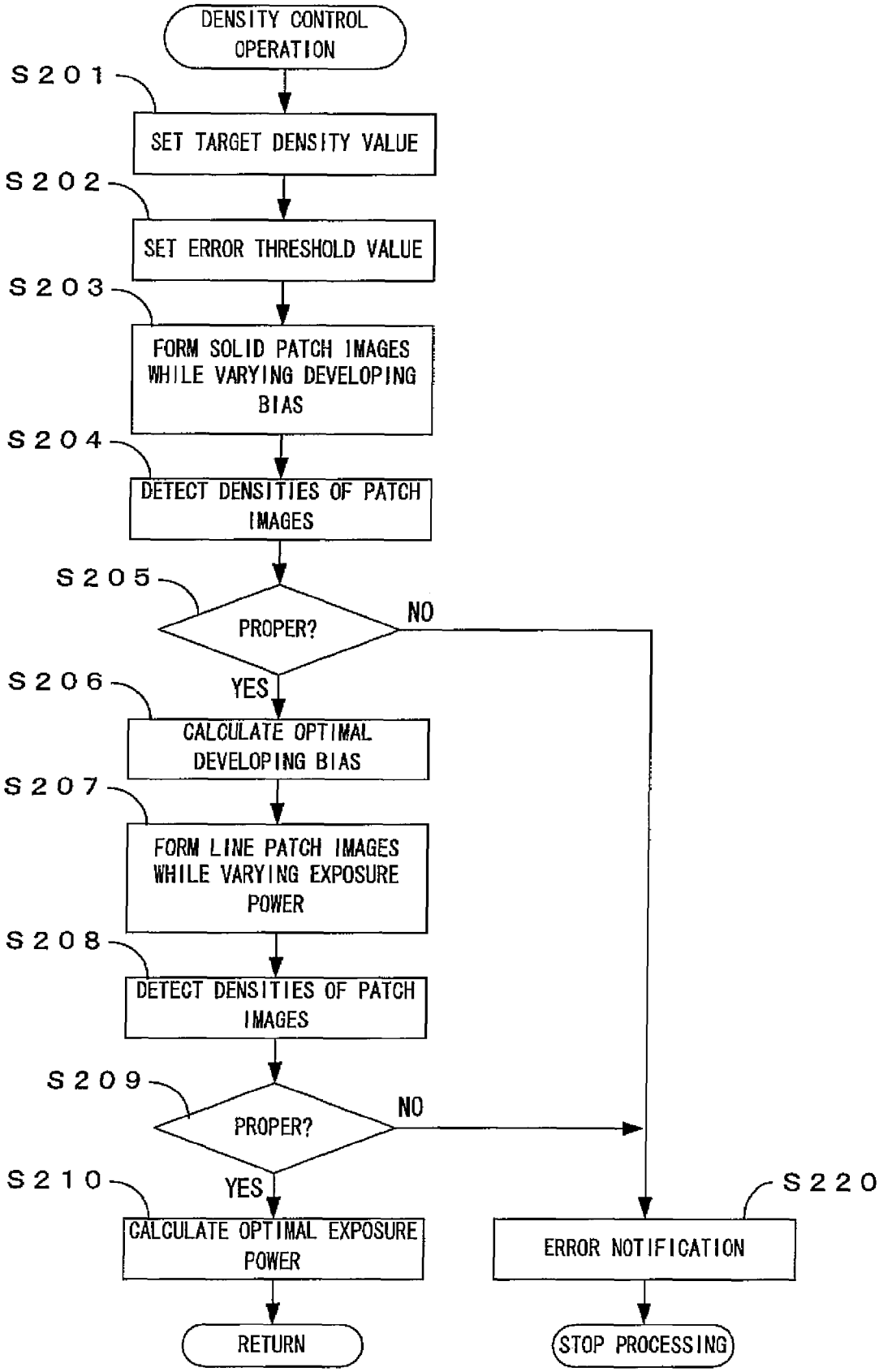
FIG. 5 is a flow chart of the density control operation.

FIG. 5 is a flow chart of the density control operation. Although shown in FIG. 5 is processing on one toner color, in the real operation, the processing in FIG. 5 is performed for the respective toner colors one after another. During the density control operation, first, a target density value for a patch image is set (Step S201). As described below, during this density control operation, the developing bias, which serves as a density adjusting factor influencing an image density, is optimized based on the density of a solid image serving as a patch image, which is followed by optimization of exposure power which serves as a density adjusting factor based on the density of a line image serving as a patch image. Among control parameters which the density control operation uses, the target densities of patch images are stored as a target density value table for each color in the memory of each developer, and the CPU 101 sets the target density value based on this table.

FIG. 6 is a drawing which shows a first example of the target density value tables. To be more precise, FIG. 6 shows a target density value table which corresponds to toner whose degree of sphericity is around 0.92 manufactured by a crushing method (hereinafter referred to as the "crushed toner"). Shown in this target density value table are target density values for patch images, in any desired units, which correspond to the use history information of each developer, namely, combinations of values representing the driving time of the developing roller and those representing the toner consumption amount, at the time of execution of the density control operation. The larger the numerical value is, the higher the target density is.

Crushed toner has a wide particle diameter distribution and a change of an image density attributable to selective development is relatively large. In an attempt to cancel this out and stably maintain an image density, the target density value table is set up so that the target density value changes in accordance with a combination of the driving time of the developing roller and the toner consumption amount which represent the use history of the toner. Further, since an image density changes depending also upon the degree of deterioration of the photosensitive member 22, the target density value table is set up so that the target density value is different between when the photosensitive member 22 is relatively new (in its initial phase) and when the photosensitive member 22 gets much deteriorated (in its later phase). In this manner, the target density value for a patch image at the present moment is determined referring to the target density value table stored in the memory of each developer. In addition, a breakpoint figure (which may for instance be "toner consumption amount=5%") of the use history information corresponds to a control threshold value which determines the execution timing of the density control operation described above.

FIG. 7 is a drawing which shows a second example of the target density value tables. To be more precise, FIG. 7 shows a target density value table which corresponds to toner whose degree of sphericity is around 0.98 manufactured by a polymerization method (hereinafter referred to as the "polymerized toner"). The basic structure of the target density value table is the same as that shown in FIG. 6 corresponding to crushed toner. Although polymerized toner has only a small particle diameter variation and does not cause a great density change attributable to selective development, when the remaining toner amount decreases, a density change owing to the influence of an external additive or the like becomes large. Hence, the use history information is delineated differently from that for crushed toner shown in FIG. 6, and a target density value is set differently in accordance with the different delineation. In more particular words, the density control operation is executed intensively when the remaining toner amount inside each developer becomes the half the initial value or less.

An image formed using crushed toner has slightly different densities between when it is carried temporarily on the photosensitive member 22 or the intermediate transfer belt 71 and when it is finally transferred and fixed on a sheet S. This density difference is different between the two types of toner described above, due to the different shapes of toner particles between the two. Since the target density value described above is set considering this as well, the target density value is different between the two types of toner.

Generally speaking, while crushed toner has a greatly varying property but is manufactured at a low cost, polymerized toner exhibits a superior property but requires a high manufacturing cost. Hence, it would be convenient to a user if the user can use polymerized toner when a high image quality is necessary but crushed toner when an image quality is not a very high priority.

The density control operation will be described continuously, referring back to FIG. 5. Setting of the target density value is followed by setting of the error threshold value (Step S202). The error threshold value is a threshold value for determining whether the density of a patch image is an appropriate value considering the structure of the apparatus. That is, when the detected density of a patch image is outside a proper range expressed by the error threshold value, something could be wrong with the apparatus or the toner. As described above, since the target density value is set in accordance with the toner inside the developer, it is necessary to set the error threshold value as well in accordance with the toner. Although not shown in FIGS. 6 and 7, the error threshold value as well may be prepared as a table.

While an image density error could be a big problem to those developers which are expected to provide a high image quality, in the event that an image quality requirement is not that strict, a larger error may be tolerated in some instances. Further, as the error threshold value is set so as to tolerate such an error, i.e., to expand the proper range, quality criteria required for the developers and the toner become more moderate, which reduces costs for manufacturing the developers and the toner. For instance, the proper range may be wider for crushed toner than for polymerized toner. From this perspective as well, it is desirable that the error threshold value is set for each developer.

After setting the target density value and the error threshold value based on the information read out from the memory of the developer, optimization processing of the developing bias as a density adjusting factor is performed (Steps S203 to S206). In other words, while varying the developing bias in multiple levels, solid images as patch images are formed at the respective developing bias levels (Step S203), and are transferred onto the intermediate transfer belt 71. The density sensor 60 detects the densities of the patch images on the intermediate transfer belt 71 (Step S204). Thus detected densities are compared with the error threshold value described above, thereby determining whether the densities of the patch images are appropriate (Step S205).

Whether the densities of the patch images are appropriate can be determined in the following manner for example. When a patch image formed under a predetermined developing bias condition has an extremely higher or lower density than a density expected under this condition, it is considered that something is wrong. Such abnormality can be detected by setting an error threshold value for this patch image density. Alternatively, an error threshold value may be set for a density difference (or a density ratio) between patch images formed under plural different developing bias conditions, so as to detect abnormality based on comparison of this density difference (or the density ratio) with the error threshold value. Further alternatively, abnormality may be detected simply based on which one of patch images formed under plural different developing bias conditions is larger or smaller than the others, or these detection methods may be combined with each other.

When it is found as a determination result that the patch image densities are proper, an optimal value of the developing bias is calculated from the detected densities of the respective patch images (Step S206). In short, from the relationship between the detected densities of the respective patch images and the set values of the developing bias at which these images were formed, such a value of the developing bias at which a solid image would match with the target density value described above is calculated and used as an optimal developing bias.

This is followed by optimization of the exposure power (Steps S207 to S210). This processing is basically the same as optimization of the developing bias except for that the exposure power of the exposure unit 6 is used as a density adjusting factor, that a line image such as a 1-ON-10-OFF image (or an appropriate halftone image) is used as a patch image (Step S207) and that values set for a line image are used as the target density value and the error threshold value.

On the other hand, when it is determined at Step S205 or Step S209 that the patch image densities are not proper, the following operation is performed. In this instance, the apparatus could have malfunctioned, abnormality could have occurred with the toner, the density sensor 60 could have been blotted, etc., any of which means that the apparatus is not in a state for normally optimizing the image forming condition or performing the image forming operation. Therefore, upon notification to a user of the abnormality by means of a predetermined error message displayed on the display 12, an alarm sound or the like (Step S220), the processing is stopped and the subsequent operation is prohibited. This prevents continued abnormal use which will damage the apparatus or permit formation of images in a poor image quality and hence wasteful use of consumables such as the toner, sheets and the like.

As described above, in this embodiment, the CPU 101 provided in the apparatus main body manages the use history information (the driving time of the developing roller and the toner consumption amount) representing the use histories of the developers 4Y, . . . which are attachable to and detachable from the apparatus main body. When the value of the use history information reaches the control threshold value yielded from the target density value table stored in the memory of the developer, the density control operation is executed which aims at adjustment of the image forming condition to thereby obtain a predetermined image density. That is, the execution timing of the density control operation is not determined in advance but determined based on the information stored in the developer, it is possible to control a density at timing suitable to the attribute of the developer, and more particularly, to the property of the toner inside the developer, and hence, to maintain an image density stably. As a result, it is possible according to this embodiment to form quality images using toner exhibiting various different properties.

Further, as for the target density value of a patch image to be used in the density control operation also, it is read out from the target density value table stored in the memory of the developer and is applied to the control. Since the target density value is set in accordance with the property of toner, it is possible according to this embodiment to obtain a predetermined image density on a sheet S regardless of the property of the toner. Further, since the target density value is set in multiple levels in accordance with the use history of the developer, it is possible to maintain an image quality stably without any significant change of an image density due to degradation of the toner or a decrease of the remaining toner amount.

In addition, as for the error threshold value to be set for a patch image density as well, since the error threshold value is saved in the developer, it is possible to set the tolerable range of density variations for each developer and to use a different developer or toner for a different purpose.

In this manner, information with respect to the execution timing of the density control operation and a target density value are saved in the developers, and the apparatus main body reads out this information to provide for control. Hence, it is possible to use various types of toner exhibiting different properties in this apparatus. Therefore, the range of properties of compatible toner is widened and a cost of manufacturing the toner may be reduced. It becomes also possible to use different types of toner in the same apparatus, to thereby benefit a user with a higher degree of freedom of selecting toner.

Further, when each developer saves information related to the use history of the developer as needed as well as the information regarding the execution timing of the density control operation and the target density value, it is possible to properly manage the use histories of the developer and the toner even when the developer is detached or attached to the apparatus main body of other apparatus.

Still further, the apparatus main body does not have to store in advance a control parameter reflecting a predicted property of the toner, which saves the memory resource. As for toner exhibiting a new property developed and manufactured after the start of use of the apparatus, when each developer saves a control parameter corresponding to that, it is possible to form images without any change from where the previously assumed toner is used.

The tone correction processing in this image forming apparatus will now be described.

Figure 8:
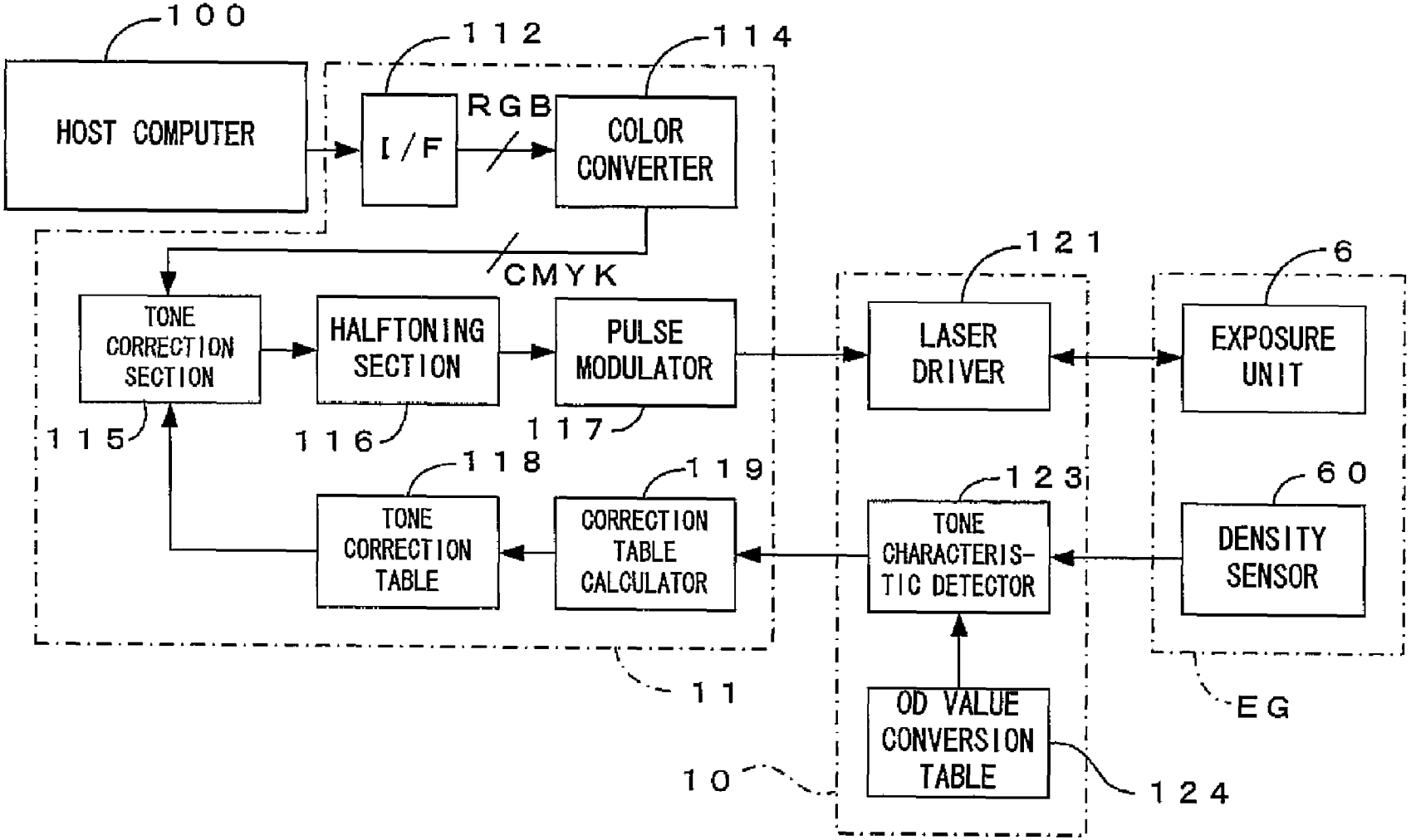
FIG. 8 is a diagram which shows tone processing blocks of the image forming apparatus.

FIG. 8 is a diagram which shows tone processing blocks of the image forming apparatus. The main controller 11 includes function blocks such as a color converter 114, a tone correction section 115, a half-toning section 116, a pulse modulator 117, a tone correction table 118, and a correction table calculator 119.

In addition to the CPU 101, the ROM 106, and the RAM 107 shown in FIG. 2, the engine controller 10 further includes a laser driver 121 for driving a laser light source provided at the exposure unit 6, a tone characteristic detector 123 which detects a tone characteristic based on a detection result given by the density sensor 60, the tone characteristic representing a gamma characteristic of the engine EG, and an OD value conversion table 124.

In the main controller 11 supplied with the image signal from the host computer 100, the color converter 114 converts RGB tone data into CMYK tone data, the RGB tone data representing tone levels of RGB components of each pixel in an image corresponding to the image signal, the CMYK tone data representing tone levels of CMYK components corresponding to the RGB components. In the color converter 114, the inputted RGB tone data comprise 8 bits per color component for each pixel (or representing 256 tone levels), for example, whereas the outputted CMYK tone data also comprise 8 bits per color component for each pixel (or representing 256 tone levels). The CMYK tone data outputted from the color converter 114 are inputted to the tone correction section 115.

The tone correction section 115 performs tone correction on the CMYK tone data of each pixel inputted from the color converter 114. Specifically, the tone correction section 115 refers to the tone correction table 118 previously stored in the non-volatile memory, and converts the CMYK tone data of each pixel inputted from the color converter 114 into corrected CMYK tone data according to the tone correction table 118, the corrected CMYK tone data representing corrected tone levels. An object of the tone correction is to compensate for the variations of the gamma characteristic of the engine EG constructed as described above, thereby allowing the image forming apparatus to maintain the overall gamma characteristic thereof in an idealistic state at all times.

The corrected CMYK tone data thus corrected are inputted to the half-toning section 116. The half-toning section 116 performs a half-toning process, such as an error diffusion process, a dithering process or a screening process, and then supplies the pulse modulator 117 with the half-toned CMYK tone data comprising 8 bits per color component for each pixel.

The half-toned CMYK tone data inputted to the pulse modulator 117 indicate respective sizes and arrays of toner dots of CMYK colors to adhere to each pixel. The pulse modulator 117 which has received the data, using the half-toned CMYK tone data, generates a video signal for pulse width modulation of an exposure laser pulse for each of CMYK color images in the engine EG and outputs the video signal to the engine controller 10 via a video interface not shown. Then, the laser driver 121, which received the video signal, controls ON/OFF of a semiconductor laser of the exposure unit 6 whereby an electrostatic latent image of each of the color components is formed on the photosensitive member 22. The usual printing is performed in this manner.

Figure 9:
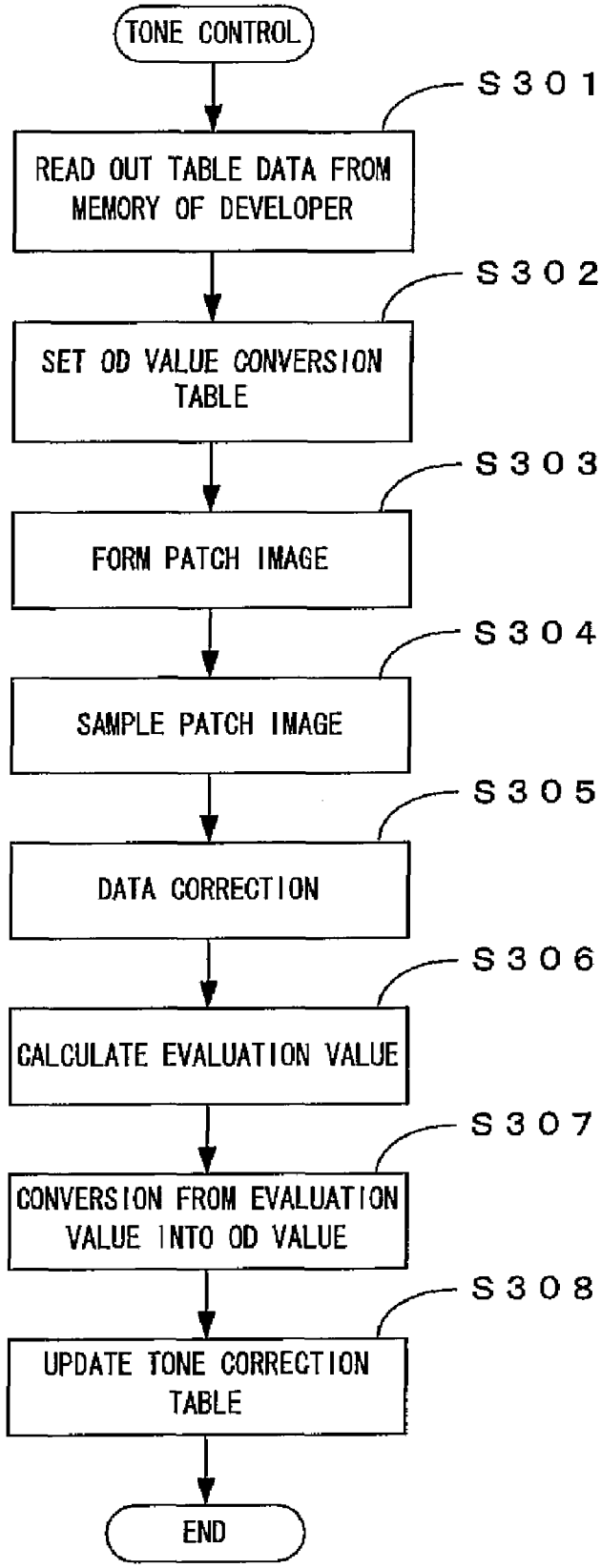
FIG. 9 is a flow chart of the tone control processing.

FIG. 9 is a flow chart of the tone control processing. The gamma characteristic of the engine EG is not always constant but changes with time. Hence, the tone correction section 115 needs to change the content of the tone correction described above in accordance with a change of the characteristic of the apparatus. In this embodiment, the tone correction table 118 is updated as needed in accordance with a change of the characteristic of the apparatus to meet this demand. Updating of the tone correction table 118 is realized when the CPU 101 executes the tone control processing shown in FIG. 9 in accordance with the program stored in advance within the ROM 106.

During the tone control processing, first, data of an OD value conversion table stored in the memories 91, . . . of the developers 4Y, . . . which are used are read out (Step S301), and the conversion processing characteristic of the OD value conversion table 124 is set based on the data (Step S302). The OD value conversion table is a conversion table for converting the density of a toner image which the density sensor 60 detects on the intermediate transfer belt 71 into an image density on a sheet (i.e., an optical density, or an OD value). In this embodiment, for the purpose of dealing with the fact that properties are different depending upon the types of toner used, the data of the OD value conversion table are stored in the memories 91, . . . provided in the developers 4Y, . . . which hold toner.

That is, the trend and the magnitude of a discrepancy between a detected density on the intermediate transfer belt and an image density on a sheet change slightly depending upon the types of toner which are distinguished by the differences of types of a pigment and an external additive, of manufacturing method, and of manufacturing plants, etc. Due to this, conversion of an image density using merely a single OD value conversion table regardless of the type of toner gives rise to many errors in the tone control processing and therefore results in a failed acquisition of a favorable halftone reproducibility. In light of this, in this embodiment, an OD value conversion table which is specific to each toner and is appropriate to the property of the toner is used, thereby achieving accurate tone control processing and formation of images with an excellent tone reproducibility.

Plural OD value conversion tables may be prepared in advance for various types of toner which may presumably be used, and may be stored in the ROM 106 of the engine controller 10. Each developer may store information indicative of which table corresponds to the property of toner inside the developer and the CPU 101 based on this information may select and use one of those plural tables prepared in advance. In this manner, the conversion processing characteristic for conversion of a detected density into an image density on a sheet is matched with the property of the toner. This however requires storage of a great amount of data in the ROM 106 of the engine controller 10 in advance and virtually limits toner usable in this apparatus only to such toner matching with the characteristics of those preliminarily prepared tables.

Noting this, in this embodiment, the memories 91, . . . provided in the developers 4Y, . . . which hold toner store the data of the tables, whereas the apparatus main body does not store the data of the tables, and conversion of a detected density into an image density on a sheet is performed based on the data read out as needed from the memories 91, . . . provided in the developers. Since the property of toner has obviously been known when each developer is filled up with this toner, a table matching with the property of the toner to use may be created and stored in the memory 91 or the like. This permits accurate execution of the tone control processing, and hence, the image forming apparatus according to this embodiment is capable of forming an image with an excellent tone reproducibility. In addition, since it is not necessary for the apparatus main body to prepare tables in advance, the memory resource is saved. Further, even toner whose property had not been predicted at the time of starting use of the apparatus becomes usable when a table stored in the memory of the developer matching with this toner is applied.

FIG. 10 is a drawing which shows one example of the OD value conversion tables. FIG. 11 is a drawing which shows other example of the OD value conversion tables. To be more precise, FIG. 10 shows an OD value conversion table which matches with one of toner A (crushed toner) manufactured by a crushing method. Meanwhile, FIG. 11 shows an OD value conversion table which matches with one of toner B (polymerized toner) manufactured by a polymerization method. As described later, the density of a toner image which is detected on the intermediate transfer belt 71 is expressed by an evaluation value normalized from 0 (toner adhesion amount being zero) to 1 (toner adhesion amount being maximum) in this embodiment. Hence, conversion of a yielded evaluation value with reference to the table shown in FIG. 10 or 11 realizes estimation of an image density on a sheet. Meanwhile, the numerical figures representing an image density on a sheet in the table shown in FIGS. 10 and 11 are expressed in any desired units.

The variation of the particle diameters of toner particles of crushed toner is relatively great and the degree of sphericity of the toner particles is not very high, whereas the variation of the particle diameters of toner particles of polymerized toner is small and the degree of sphericity of the toner particles is high. Because of these differences, as one can tell from comparison of FIG. 10 with FIG. 11, even when detected densities on the intermediate transfer belt 71 are the same, image densities on a sheet are not necessarily the same.

Further, the image forming operation performed by this type of apparatus accompanies selective development which is selective consumption of toner attributable to different particle diameters and different charging amounts of the toner. Hence, as a developer is used more, the particle diameter distribution and the charging amount distribution of the toner inside the developer gradually change. The property of the toner changes with time due to fatigue-induced degradation of the toner as well. With this, particle diameter distribution of toner constituting a toner image is different, for instance, between the toner image which is formed with a large amount of the toner left inside a developer which is new and the toner image which is formed with a decreased amount of the toner left inside a developer which has been used for a while. Due to this, the correlation between a detected density on the belt and an image density on a sheet changes as well. In light of this, the conversion tables shown in FIGS. 10 and 11 contain numerical values which correspond to these two states, i.e., one that the remaining toner amount is large and the other that the remaining toner amount is small. The CPU 101 switches to use the numerical figures in the tables in accordance with the comparison result between the remaining toner amount in the respective developers which the CPU 101 manages and a predetermined switchover threshold value. It is therefore possible to suppress a variation of the halftone reproducibility associated with a change of the remaining toner amount and stably maintain an image quality.

It is generally believed that the degree of the variation of the halftone reproducibility with a change of the remaining toner amount is different depending upon the toner used. For example, since an initial particle diameter distribution of crushed toner is great, as the diameter distribution gradually changes because of selective development, an image density as well gradually changes. Meanwhile, in the case of polymerized toner, the diameter distribution is relatively small, and hence, it is predicted that an image density does not change so much at an initial stage but abruptly changes when the remaining toner amount decreases beyond a certain level. It is therefore desirable to determine the timing of the switchover of the conversion tables in accordance with toner to be used. To make this possible, the memories of the developers may store and use the switchover threshold values mentioned above for instance which are for switching the tables.

The tone control processing will be described continuously, referring back to FIG. 9. Upon preparation of the OD value conversion table suitable to the toner used in the manner described above, a patch image having a predetermined image pattern is formed (Step S303). Meanwhile, reading out the table data from the memory of the developer (Step S301) and setting the OD value conversion table (Step S302) may not necessarily be performed for every execution of the tone control processing. These processing may be performed at proper timing which may be right after power-on of the apparatus, immediately after attaching of the developer, or the like, and the data may be stored in the RAM 107 for instance, and the data may be used in the tone control processing.

Figure 12A:
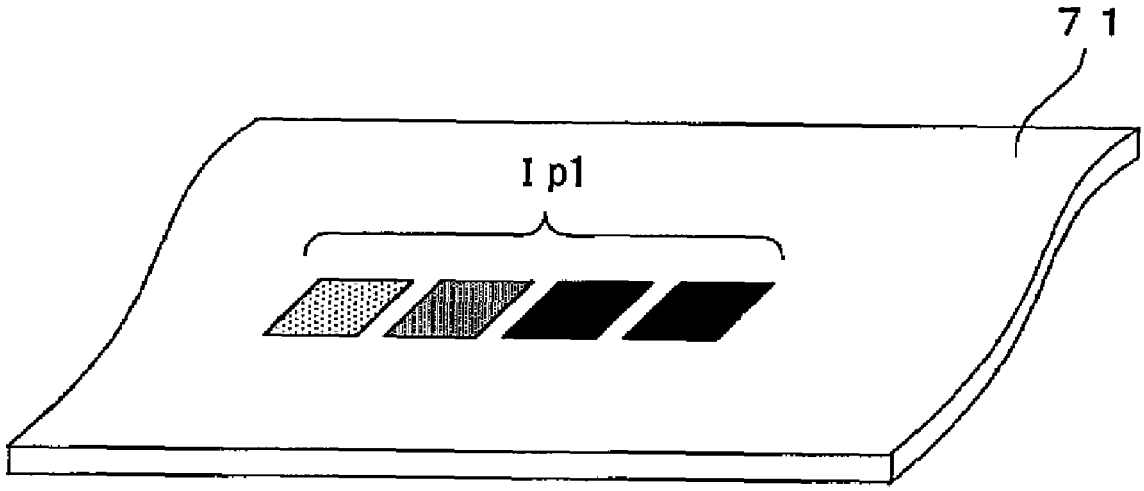
FIGS. 12A and 12B are drawings which show examples of patch images.
Figure 12B:
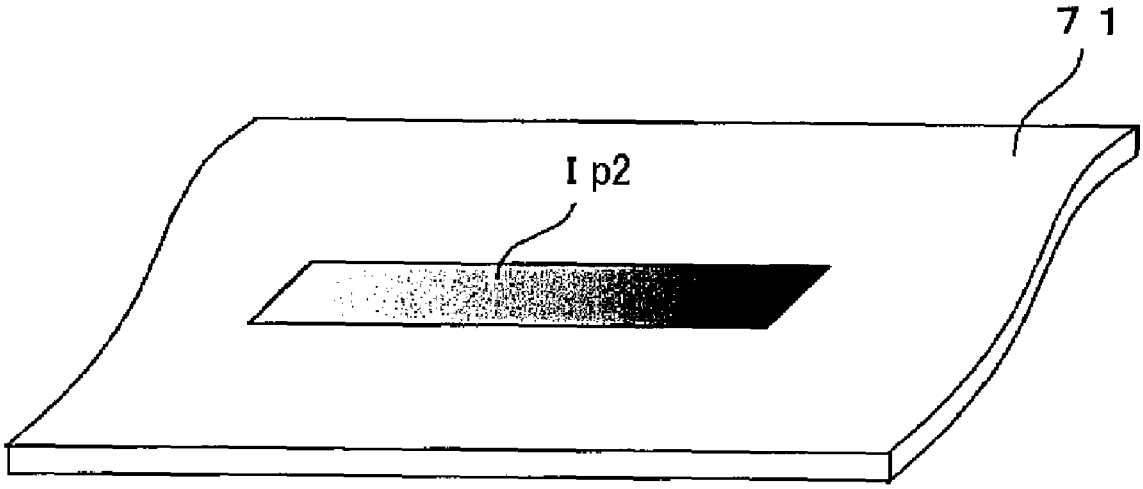

FIGS. 12A and 12B are drawings which show examples of patch images. Patch images in the tone control processing are preferably images having plural tone levels. For instance, a patch image Ip1 composed of multiple patch image pieces of tone levels different from each other as the one shown in FIG. 12A, or a patch image Ip2 whose tone level gradually changes inside a continuous image as the one shown in FIG. 12B may be used. Meanwhile, in the example in FIG. 12A, the respective patch pieces may be contiguous to each other.

The tone control processing will be described continuously, referring back to FIG. 9. For each tone level of the thus formed patch image, the signal which is outputted from the density sensor 60 is sampled (Step S304). Since the resulting sampling data may contain noises, data correction is carried out as needed (Step S305). While being processing which aims at suppression of the influence of the noises over the result, this data correction is not essential to the invention and will therefore not be described in detail.

It is a signal whose level changes in accordance with the light quantity outgoing from the intermediate transfer belt 71 against which the density sensor 60 is opposed that is outputted from the density sensor 60. In other words, in a condition that the intermediate transfer belt 71 carries no toner at all, the light quantity outgoing from the intermediate transfer belt 71 is the greatest, and as the amount of toner that covers the surface of the intermediate transfer belt 71 increases, the light quantity decreases. Hence, the output level from the density sensor 60 is the highest when no toner adheres to the intermediate transfer belt 71, and generally speaking, as the toner amount adhering to the intermediate transfer belt 71 increases, the output level decreases (in the case of black toner). As for color toner however, the output level may become higher on the contrary in the area the toner amount is large. Meanwhile, in a patch image which is formed with the toner adhering to the intermediate transfer belt 71, the greater the amount of toner is, the higher the density of the patch image is. It is thus hard to tell that the level of the output signal from the density sensor 60 directly expresses the density of a patch image.

Noting this, in this embodiment, as a numerical value which is more directly indicative of the density of a patch image, an "evaluation value" of a patch image described hereinafter is introduced (Step S306). The evaluation value is a value such that it is zero when the density of a patch image is zero, that is, when there is no toner, but it increases as the toner amount viewed as a patch image increases. To be more specific, the evaluation value G is calculated from the following formula:

$$G=1-(Ps-P\min)/(P\max-P\min)$$

where the symbol Ps denotes sampling data on a patch image (as it is after data correction). Meanwhile, the symbol Pmax denotes sampling data on the intermediate transfer belt 71 which carries no toner, and as such, is the largest value the output from the sensor can have. The symbol Pmin denotes sampling data on the intermediate transfer belt 71 which is covered completely with toner, and as such, is the smallest value the output from the sensor can have.

With these definitions applied, in a condition that the intermediate transfer belt 71 carries no toner at all, the evaluation value G is zero, since sampling data Ps have the maximum value Pmax. As the toner amount increases, the sampling data Ps become smaller and the evaluation value G increases. And when toner completely covers the intermediate transfer belt 71, the sampling data Ps have the minimum value Pmin and the evaluation value G is therefore one. In short, using the evaluation value G defined as described above, the density of a patch image is expressed by a normalized value which varies from zero which corresponds to the lowest density to one which corresponds to the highest density.

The "image density" of a patch image in this context expresses accurately a large amount or small amount of toner constituting the patch image, and as described earlier, is not the same as the density of an image on a sheet S which is obtained by transferring and fixing the patch image on the sheet S. At this stage, the final objective of tone correction is to secure the best quality of an image formed on a sheet S. To realize this objective, it is desirable that the content of the tone correction processing is determined factoring in the density detection result of a patch image on a sheet S which is fed back. However, forming a patch image on a sheet S for this purpose is not practical since it results in extra consumption of sheets S and gives rise to the necessity of separately disposing a patch image density detector for detecting the density of a patch image fixed on a sheet S. In the case of an image forming apparatus equipped with a scanner for reading an original document such as a copier machine and a multifunction apparatus, the scanner can be used for this purpose. It is nevertheless necessary to transport a sheet S carrying a patch image to a position where the scanner can read the patch image.

In light of this, in the image forming apparatus, the density detection result of a patch image on the intermediate transfer belt 71 (evaluation value) is converted into the density of an image on a sheet S (optical density; OD value) with reference to the OD value conversion table 124 described earlier, whereby the image density on the sheet S is provided as feedback substantially for the tone correction processing. In other words, as shown in FIGS. 8 and 9, the tone characteristic detector 123 converts the evaluation value G of a patch image on the intermediate transfer belt 71 obtained earlier into an OD value on a sheet S with reference to the OD value conversion table 124 (Step S307), and this OD value is fed back to the correction table calculator 119. The correction table calculator 119 then performs predetermined calculation, thereby updating the content of the tone correction table 118 so that a tone level expressed by an inputted image signal will match with the actual tone level of an image on a sheet S (Step S308). In this manner, the tone control processing is executed and the tone correction table 118 is accordingly updated as needed, hence it is possible to form a quality image stably regardless of a variation of the characteristic of the apparatus.

As described above, in this embodiment, the density detection result of a patch image on the intermediate transfer belt 71 is provided for the tone control processing after converted into an image density on a sheet S which is the final recording material. This makes it possible to attain a high tone reproducibility on the sheet S, and therefore, according to this embodiment, it is possible to form an image in a favorable and stable image quality.

To be noted in particular, since the conversion processing characteristic by means of the OD value conversion tables is not uniform but conversion is performed based on the data stored in the memories 91, . . . of the developers 4Y, . . . , a conversion processing characteristic suitable to the property of toner used is always applied, which secures an even better tone reproducibility. In addition, selective use of one of conversion tables in accordance with a changed amount of remaining toner ensures a stable image quality regardless of a change of the property of the toner with time.

As described above, in this embodiment, the engine EG functions as the "image forming section" of the invention. It is to be noted in particular that the intermediate transfer belt 71 constituting the engine EG functions as the "image carrier" of the invention, while the intermediate transfer belt 71 and the fixing unit 9 collectively function as the "transfer fixing section" of the invention. The density sensor 60 functions as the "density detector" of the invention. The memories 91, . . . provided in the respective developers 4Y, . . . function as the "memory" of the invention. The OD value conversion table 124 corresponds to the "conversion table" of the invention, the tone characteristic detector 123 which converts an image density based on the table functions as the "converter" of the invention, and the CPU 101 functions as the "controller" of the invention.

Further, in the embodiment above, the data of the OD value conversion tables stored in the memories of the developers prepared for the respective toner correspond particularly to the "attribute information" of the invention which is contained in the "specific information" of the invention. The switchover threshold values used for switching among the OD value conversion tables in accordance with the remaining toner amount corresponds to the "timing information" of the invention.

Further, in the embodiment above, of the information stored as the density target value tables in the memories 91, . . . provided in the respective developers, the control threshold values (the driving times of the developing rollers and the toner consumption amounts) regarding the timing of executing the density control operation correspond particularly to the "timing information" of the invention which is contained in the "specific information" of the invention, while the density target values and the error threshold values correspond particularly to the "specific-to-developer control parameter" which is contained in the "specific information" of the invention.

The invention is not limited to the embodiment above, but may be modified in various manners in addition to the preferred embodiments above, to the extent not deviating from the object of the invention. For instance, in the embodiment above, the density control operation is performed on all developers when the use history information regarding one developer has reached the associated control threshold value, but the invention is not limited to this. The density control operation may be performed on one such developer alone or when the use history information has reached the associated control threshold values on a predetermined number of developers, for example. Alternatively, the use history information may be matched against the associated control threshold values regarding other developers when the use history information has reached the associated control threshold value on one developer and whether to execute the density control operation may be determined based on the matching result, for example. Further alternatively, even when the use history information has reached the associated control threshold value on one developer, if not much time has elapsed since the last density control operation due to power-on, attaching of the developer, or other developer, the density control operation may be omitted for this time, for example.

In addition, in the embodiment above, the CPU 101 reads out the information which is stored in the density target value table stored in the memories 91, . . . provided in the respective developers 4Y, . . . immediately after power-on of the apparatus or attaching of the developer (FIG. 3) for example. However, the CPU 101 does not have to grasp all these information all times. The following may therefore be an alternative. In the event that it is possible to read out the information of the memory provided in the developer during an initial stage of the density control operation, the CPU 101 only needs to grasp at least the timing to start the next density control operation. At the outset of the density control operation, it may read out from the memory of the developer and store the control parameter such as the target density value to use during the started controlling operation and the control threshold value which is for determining the timing at which the next density control operation should be executed. Alternatively, at the time of execution of the density control operation, the CPU may read out and store the control threshold value regarding the next density control operation and the value of the control parameter to be used during that control operation. This makes it unnecessary for the CPU 101 to store all numerical values contained in the tables, which saves the memory resource.

Further, in the embodiment above, of the control parameters to apply to the density control operation, those specific to the developer, namely, the control parameters regarding the attribute of the developer are stored in the memory of the developer and the timing information which determines the timing of executing the density control operation is stored in the memory of the developer and the CPU 101 reads out these information as needed. However, considering the intention of the invention, the control parameters need not always be read out from the developers. The density control operation may be executed by applying control parameters set in advance as in the conventional techniques.

Further, according to the embodiment described above, of the control parameters to use in the density control operation, the target density value of a patch image and the associated error threshold value are stored in the memory of the developer as values specific to the developer. However, it may be more preferable in some instances to change in accordance with the properties of the developer and toner besides these, for example, the variable ranges of the developing bias, the exposure power and the like, which serve as density adjusting factors for formation of a patch image, the pitches in varying the developing bias, the exposure power and the like, the number of patch images to form, and the like. Noting this, these conditions may be stored in the memory of the developer as control parameters specific to the developer and those parameters read out from the memory may be used at the time of execution of the density control operation.

Further, although the embodiment above the target density value of a patch image is gradually changed in accordance with a change of use history information regarding the developer in order to suppress a variation of an image density due to a change with time of the property of toner inside the developer. However, in the case where a variation of an image density with time is not very significant, or a gradual change of the density is tolerable or the like, unique target density value may be set for each developer.

Further, in the embodiment above, although the evaluation values (the amounts of toner) regarding patch images calculated based on an output from the density sensor 60 are converted into OD values on the sheet S with reference to the OD value conversion tables, the conversion into OD values may not rely upon the tables but may instead be computed.

Further, in the embodiment above, although the conversion processing characteristic for conversion of a detected density on the intermediate transfer belt into an image density on a sheet is not prepared in the apparatus main body but completely dependent upon the data stored in the memories of the developers, the following may be exercised instead. That is, representative one among toner exhibiting various properties is used as standard toner, and a conversion processing characteristic suitable to this toner is saved in the form of a table or formula in the ROM 106 of the apparatus main body for instance as a "standard characteristic". And, as for toner to which the standard characteristic can be applied, the standard characteristic is used as it is for conversion. As for toner which exhibits a greatly different property and to which the standard characteristic cannot be applied on the other hand, the standard characteristic is corrected based on correction information stored in the memory of the developer and conversion is executed using the corrected characteristic.

Figure 13:
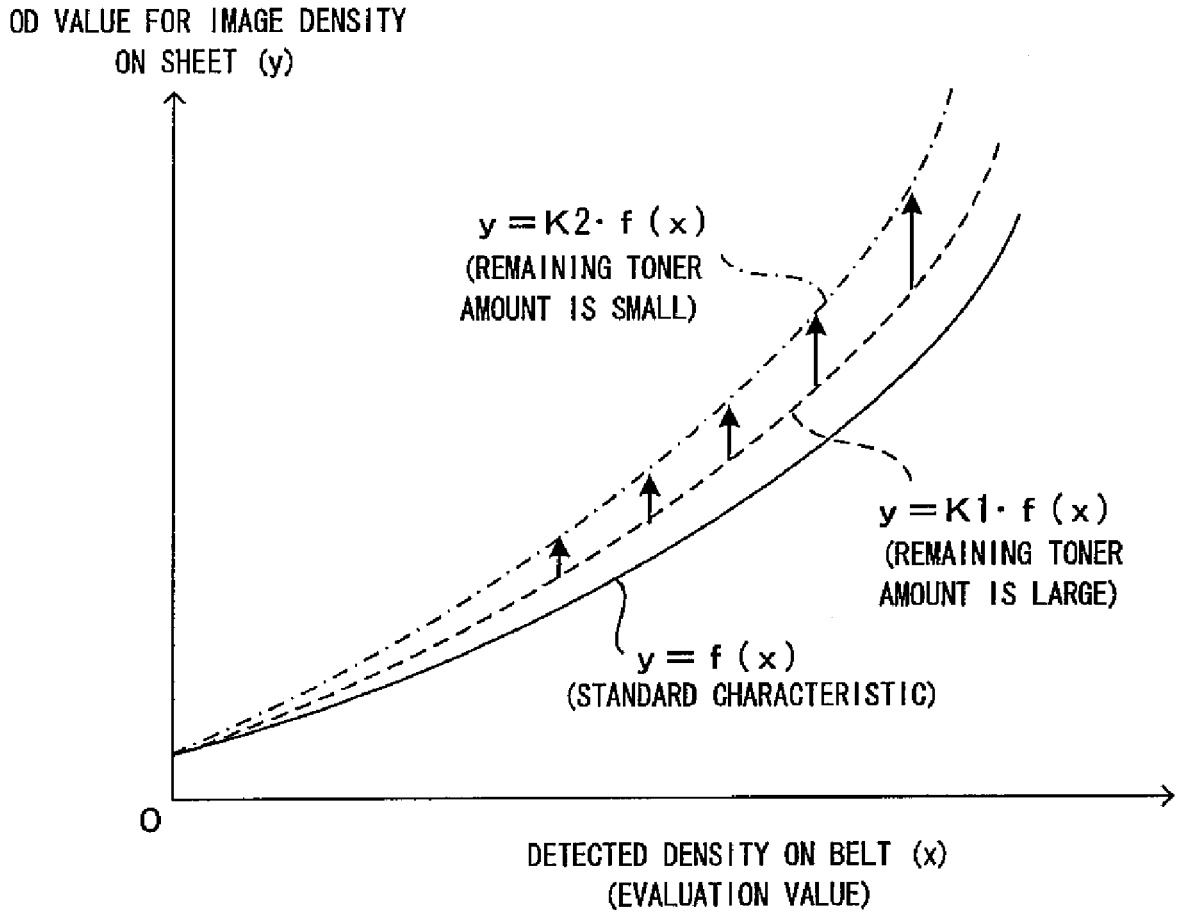
FIG. 13 is a drawing which shows one example of a method of determining the conversion processing characteristic by correcting the standard characteristic.

FIG. 13 is a drawing which shows one example of a method of determining the conversion processing characteristic by correcting the standard characteristic. It is assumed that the standard characteristic, namely, the relationship between a detected density on the intermediate transfer belt (evaluation value) and an image density on a sheet with respect to standard toner is expressed by:

$$y=f(x)$$

as denoted at the solid line in FIG. 13. Meanwhile, the standard characteristic is not necessarily limited to such a characteristic which is expressed by one characteristic curve. Several characteristic curves may be prepared in accordance with the remaining toner amount, for instance.

In the event that toner actually used tends to achieve a higher image density on a sheet at the same evaluation value than the standard toner would, a characteristic calculated by multiplying the standard characteristic f(x) by a coefficient which is larger than 1 for example may be used as the conversion processing characteristic. When this toner has such a nature that an image density on a sheet at the same evaluation value increases as the remaining toner amount decreases, the conversion processing characteristic for this toner can be expressed using correction coefficients K1 and K2 by the following formulae:

$y=K1 \cdot f(x)$ when the remaining toner amount is large; and $y=K2 \cdot f(x)$ when the remaining toner amount is small (where $K2>K1$), as denoted at the dashed line and the dashed-dotted line in FIG. 13. Further, instead of applying two formulae which use two coefficients in accordance with the remaining toner amount in this manner, more correction coefficients may be set and the conversion processing characteristic may accordingly be changed gradually in the direction denoted at the arrows in FIG. 13. Further alternatively, in order to express a more complex characteristic, a characteristic curve may be divided into several sections and one correction coefficient may be set for each section.

It is thus possible to perform appropriate conversion which suits toner by means of application of the preliminarily prepared standard characteristic to conversion while correcting the standard characteristic as needed depending upon the type of the toner. Since only the standard characteristic needs be prepared in the apparatus main body in this instance, the conversion tables demand less memory resource of the apparatus main body. In addition, since the memories of the developers need to store only the information for correction (the correction information), the memory resource of the memories of the developers is saved as well. The "correction information" to store in the memories of the developers may of course be in the form of a table as that shown in FIG. 10. In this case, a standard OD value conversion table prepared in the apparatus main body may be rewritten into tables stored in the memories of the developers and used.

Further, according to this method, it is possible to omit storage of the information in the developers as for toner to which the standard characteristic can be applied. Hence, for example, as for developers filled with standard toner, memories may not be provided therein and a detected density may be converted into an image density on a sheet applying the standard characteristic. On the other hand, a memory storing correction information may be provided in a developer filled with toner of a higher quality and the conversion may be performed using a conversion processing characteristic corrected based on the correction information, thereby obtaining high-quality images. In this manner, it is possible to use developers differently depending upon purposes.

Further, although the two numerical values are prepared in the OD value conversion tables or the formulae in accordance with the remaining toner amount according to the embodiment described above, preparing multiple numerical values in this manner is not indispensable to the invention. On the contrary, more numerical values may be prepared. In addition, in the embodiment described above, the numerical value of the OD value conversion table is switched in accordance with the remaining toner amount. However, the switching may be conducted based on other parameter instead which expresses the state of use of the toner or the switching may be conducted in accordance with both the remaining toner amount and the other parameter. For instance, a parameter indicative of the degree of degradation of toner inside each developer may be the driving time of the developing roller which is provided in the developer.

Further, in the embodiment described above, the density sensor 60 is structured to detect the amount of toner of a toner image carried on the intermediate transfer belt 71. However, other than this, the density sensor 60 may be structured to detect the amount of the toner which is on the photosensitive member 22. In this case, the photosensitive member 22 corresponds to the "image carrier" of the invention and the OD value conversion tables are defined as tables which express the relationship between the density detection result of a toner image on the photosensitive member 22 and the density of an image which is obtained when the toner image on the photosensitive member 22 is transferred and fixed on a sheet S, which is a recording material, via the intermediate transfer belt 71.

Further, although the embodiment described above is directed to the application of the invention to an image forming apparatus comprising the intermediate transfer belt 71, the invention is applicable also to an apparatus which does not comprise such an intermediate transfer medium but is structured so as to transfer a toner image directly to a recording material from a photosensitive member. Even in such an instance as well, an image density discrepancy between a medium on which the amount of toner is detected and a final recording material is calculated in advance and tone correction is performed based on the calculation result, whereby a similar effect is attained. And as a result, it is possible to obtain a favorable image quality on the recording material. The invention is further applicable to an apparatus which comprises other intermediate transfer medium than an intermediate transfer belt, for example, an intermediate transfer drum or an intermediate transfer sheet. In addition, the density adjusting factors are not limited only to the developing bias and the exposure power as in the embodiment described above.

Further, although the embodiment described above is directed to the application of the invention to an apparatus which forms images using toner of the four colors, i.e., yellow, magenta, cyan and black, the types and the number of the toner colors are not limited to this but may be determined arbitrarily. In addition, the invention is applicable not only to an apparatus of the rotary development type described in the embodiment above but also to an image forming apparatus of the so-called tandem type in which developers corresponding to the respective toner colors are arranged in line in the direction of transporting a sheet. Moreover, the invention is not limited only to an image forming apparatus of the electrophotographic type described in the embodiment above but to image forming apparatuses in general, including apparatuses of other types such as an apparatus in which toner flies onto a transfer medium and accordingly an image is formed.

Further, the memory in the image forming apparatus may further store the use history information corresponding to the developer fed from the controller.

Further, the memory in the image forming apparatus may further store a control parameter regarding the developer required for the controller to execute the density control operation, and the controller may execute the density control operation applying the control parameter read out from the memory.

Further, the specific-to-developer control parameter in the image forming apparatus may include a value which corresponds to a target density of the patch image, and the controller may control the image forming condition so that the density of the patch image matches the target density.

Further, the density control operation in the image forming apparatus may be configured so that, while varying a density adjusting factor in multiple levels, the patch image may be formed at each level of the density adjusting factor, the density adjusting factor affecting an image density, and the specific-to-developer control parameter may include information which is indicative of a mode of setting the density adjusting factor in the density control operation.

Further, the memory in the image forming apparatus may further store timing information at which the controller should execute the density control operation, and the controller may execute the density control operation at the timing which is set based on the timing information read out from the memory.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a developer which is attachable to and detachable from an apparatus main body and which holds toner;

an image forming section which forms a toner image using the toner held inside the developer; and a controller which executes a density control operation of forming a patch image using the toner held inside the developer and controlling an image forming condition for the image forming section based on a density detection result of the patch image, wherein the developer includes a memory which stores specific information regarding an attribute which is specific to the developer, the controller determines a mode of the density control operation based on the specific information read out from the memory, the memory stores, as the specific information, timing information regarding the timing at which the density control operation using the developer should be executed, and the controller executes the density control operation at the timing which is determined based on the timing information read out from the memory.

2. The image forming apparatus of claim 1, wherein the timing information contains a threshold value which is set in accordance with use history information indicative of a physical quantity which changes with use of the developer, and the controller manages the use history information and executes the density control operation when the value of the use history information reaches the threshold value.

3. The image forming apparatus of claim 1, wherein the controller reads out the specific information stored in the memory upon power-on of the apparatus.

4. The image forming apparatus of claim 1, wherein the controller reads out the specific information stored in the memory when a developer is attached to the apparatus main body.

5. The image forming apparatus of claim 1, wherein at the time of execution of the density control operation, the controller reads out the timing information regarding the next density control operation from the memory.

6. An image forming apparatus comprising:

a developer which is attachable to and detachable from an apparatus main body and which holds toner;

an image forming section which forms a toner image using the toner held inside the developer; and a controller which executes a density control operation of forming a patch image using the toner held inside the developer and controlling an image forming condition for the patch image, wherein the developer includes a memory which stores specific information regarding an attribute which is specific to the developer, the controller determines a mode of the density control operation based on the specific information read out from the memory, the memory stores as the specific information a specific-to-developer control parameter, from among control parameters which are required for the density control operation, which should be set in accordance with attributes of the developer and toner inside the developer, and the controller executes the density control operation applying the specific-to-developer control parameter read out from the memory.

7. The image forming apparatus of claim 6, wherein the specific-to-developer control parameter includes a value which corresponds to a control target condition which is a target image forming condition in the density control operation, and the controller executes the density control operation so that the image forming condition matches the control target condition.

8. The image forming apparatus of claim 6, wherein the specific-to-developer control parameter includes a value which is indicative of a proper range of the density of the patch image, and the controller executes predetermined error processing when the density detection result of the patch image is not within the proper range.

9. An image forming apparatus comprising:

a developer which is attachable to and detachable from an apparatus main body and which holds toner;

an image forming section which forms a toner image using the toner held inside the developer; and a controller which executes a density control operation of forming a patch image using the toner held inside the developer and controlling an image forming condition for the image forming section based on a density detection result of the patch image, wherein the developer includes a memory which stores specific information regarding an attribute which is specific to the developer, the controller determines a mode of the density control operation based on the specific information read out from the memory, and the memory stores, as the specific information, attribute information regarding the attribute of toner held inside the developer, and the image forming section includes an image carrier which carries a toner image, and a transferring/fixing section which finally transfers and fixes the toner image on a recording material, the apparatus further comprising:

a density detector which detects a density of a toner image which is formed as the patch image by the image forming section on the image carrier; and a converter which performs conversion processing in which the density of the patch image on the image carrier detected by the density detector is converted into an image density on the recording material, wherein the controller adjusts an operating condition for an image forming operation performed by the image forming section based on a conversion result obtained by the converter, to thereby control the image density on the recording material, and a conversion processing characteristic of the conversion processing performed by the converter is set based on the attribute information read out from the memory.

10. The image forming apparatus of claim 9, wherein a plurality of types of conversion processing characteristic different from each other are prepared in advance as the conversion processing characteristic of the conversion processing performed by the converter, and the converter performs the conversion processing using one conversion processing characteristic which is selected based on the attribute information from among the plurality of types of conversion processing characteristic.

11. The image forming apparatus of claim 9, wherein a standard conversion processing characteristic is prepared in advance as the conversion processing characteristic of the conversion processing performed by the converter, and the converter performs the conversion processing using a corrected conversion processing characteristic which is obtained by correcting the standard conversion processing characteristic based on the attribute information.

12. The image forming apparatus of claim 9, wherein the attribute information expresses the conversion processing characteristic which matches with toner held inside the developer, and the converter performs the conversion processing using the conversion processing characteristic which is expressed by the attribute information.

13. The image forming apparatus of claim 9, wherein the converter performs the conversion processing based on a conversion table which is indicative of a correlation between an image density on the image carrier and an image density on the recording material.

14. The image forming apparatus of claim 9, wherein the memory further stores timing information which is indicative of a timing at which the conversion processing characteristic of the conversion processing performed by the converter should be changed in accordance with a change with time of the property of toner held inside the developer, and the converter changes the conversion processing characteristic based on the timing information out read from the memory.

15. The image forming apparatus of claim 9, wherein the controller controls a tone correction characteristic of the apparatus based on a conversion result obtained by the converter.

16. A method of controlling an image forming apparatus comprising:

storing specific information regarding an attribute which is specific to a developer in a memory provided in the developer which is attachable to and detachable from an apparatus main body;

reading out the specific information stored in the memory;

determining, based on the specific information, a mode of a density control operation of forming a toner image using toner held inside the developer as a patch image, and of controlling an image forming condition for an image forming section based on a density detection result of the patch image; and executing the density control operation in thus determined mode, wherein timing information is stored in the memory as the specific information, the timing information regarding a timing at which the density control operation using the developer to execute, the timing information is read out which is stored in the memory provided in the developer, and the density control operation is executed at a timing determined based on the timing information.

17. A method of controlling an image forming apparatus comprising:

storing specific information regarding an attribute which is specific to a developer in a memory provided in the developer which is attachable to and detachable from an apparatus main body;

reading out the specific information stored in the memory;

determining, based on the specific information, a mode of a density control operation of forming a toner image using toner held inside the developer as a patch image, and of controlling an image forming condition for an image forming section based on a density detection result of the patch image; and executing the density control operation in thus determined mode, wherein a specific-to-developer control parameter is stored in the memory as the specific information, the specific-to-developer control parameter corresponding to attributes of the developer and the toner inside the developer, and in executing the density control operation, the specific-to-developer control parameter read out from the memory is applied.

18. A method of controlling an image forming apparatus comprising:

storing specific information regarding an attribute which is specific to a developer in a memory provided in the developer which is attachable to and detachable from an apparatus main body;

reading out the specific information stored in the memory;

determining, based on the specific information, a mode of a density control operation of forming a toner image using toner held inside the developer as a patch image, and of controlling an image forming condition for an image forming section based on a density detection result of the patch image; and executing the density control operation in thus determined mode, wherein attribute information is stored in the memory as the specific information, the attribute information regarding an attribute of toner held inside the developer, and in executing the density control operation:

conversion processing is performed which is conversion of the density detection result of the patch image on an image carrier into an image density on the recording material, an operating condition for an image forming operation performed by the image forming section is adjusted based on the result of the conversion processing, to thereby control the image density on the recording material, and the conversion processing characteristic for the conversion processing is set based on the attribute information read out from the memory.

* * * * *